US007489763B2

(12) United States Patent
Lenz

(10) Patent No.: US 7,489,763 B2
(45) Date of Patent: Feb. 10, 2009

(54) ROTARY ANODE X-RAY RADIATOR

(75) Inventor: Eberhard Lenz, Erlangen (DE)

(73) Assignee: Siemens Aktiengesellschaft, Munich (DE)

( * ) Notice: Subject to any disclaimer, the term of this patent is extended or adjusted under 35 U.S.C. 154(b) by 172 days.

(21) Appl. No.: 11/493,790

(22) Filed: Jul. 25, 2006

(65) Prior Publication Data

US 2007/0064874 A1 Mar. 22, 2007

(30) Foreign Application Priority Data

Jul. 25, 2005 (DE) ..... 10 2005 034 687

(51) Int. Cl.
*H01J 35/10* (2006.01)

(52) U.S. Cl. ..... 378/127; 378/125; 378/143; 378/144

(58) Field of Classification Search ..... 378/121, 378/125, 127, 128, 143, 144, 129
See application file for complete search history.

(56) References Cited

U.S. PATENT DOCUMENTS

| | | | | |
|---|---|---|---|---|
| 3,710,170 | A * | 1/1973 | Fiedel | 378/125 |
| 3,751,702 | A | 8/1973 | Dietz | |
| 3,790,836 | A * | 2/1974 | Braun | 378/127 |
| 3,836,804 | A * | 9/1974 | Frens et al. | 378/125 |
| 3,959,685 | A * | 5/1976 | Konieczynski | 378/144 |
| 4,145,632 | A * | 3/1979 | Devine, Jr. | 378/144 |
| 4,189,658 | A * | 2/1980 | Schleinkofer | 378/144 |
| 4,520,496 | A * | 5/1985 | Schreiber et al. | 378/128 |
| 4,531,227 | A | 7/1985 | Fukuharar et al. | |
| H312 | H * | 7/1987 | Parker | 378/127 |
| 4,847,883 | A * | 7/1989 | Fourre | 378/144 |
| 4,901,338 | A * | 2/1990 | Rodhammer et al. | 378/144 |
| 4,943,989 | A * | 7/1990 | Lounsberry et al. | 378/130 |
| 4,993,055 | A * | 2/1991 | Rand et al. | 378/125 |
| 5,008,918 | A * | 4/1991 | Lee et al. | 378/144 |
| 5,629,970 | A * | 5/1997 | Woodruff et al. | 378/143 |
| 5,822,395 | A * | 10/1998 | Schardt et al. | 378/137 |
| 5,883,936 | A * | 3/1999 | Hell et al. | 378/125 |
| 6,084,942 | A | 7/2000 | Hell et al. | |
| 6,301,333 | B1 * | 10/2001 | Mearini et al. | 378/143 |
| 6,396,901 | B1 | 5/2002 | Hell et al. | |
| 6,400,800 | B1 * | 6/2002 | Warren | 378/144 |
| 7,197,119 | B2 * | 3/2007 | Freudenberger et al. | 378/141 |
| 2005/0185761 | A1 | 8/2005 | Freudenberger et al. | |

FOREIGN PATENT DOCUMENTS

DE 10 2004 003 368 A1 8/2005

OTHER PUBLICATIONS

CRC Handbook of Chemistry and Physics 2000-2001, p. 12-197-12-199.*

* cited by examiner

*Primary Examiner*—Allen C. Ho
(74) *Attorney, Agent, or Firm*—Schiff Hardin LLP

(57) ABSTRACT

A rotary anode x-ray radiator has an anode produced from a first material as well as a cathode. A structure for accommodation of at least one heat conductor element produced from a second material is provided on an external side of the anode facing away from the cathode, in an annular segment situated opposite the anode. The second material exhibits a higher heat conductivity than the first material. The heat conductor elements are accommodated in the structure to form expansion gaps.

20 Claims, 3 Drawing Sheets

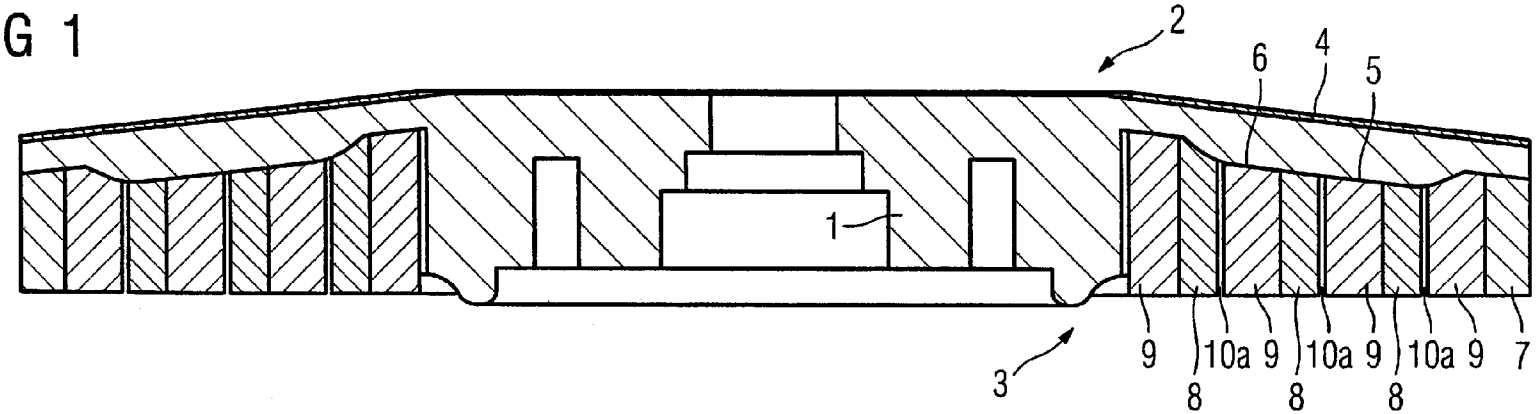
FIG 1
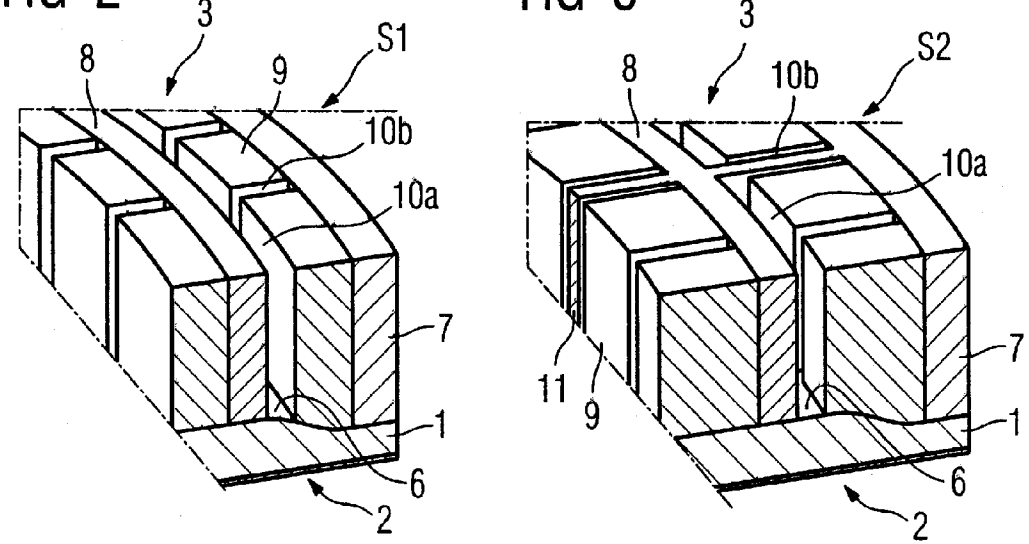
FIG 2
FIG 3
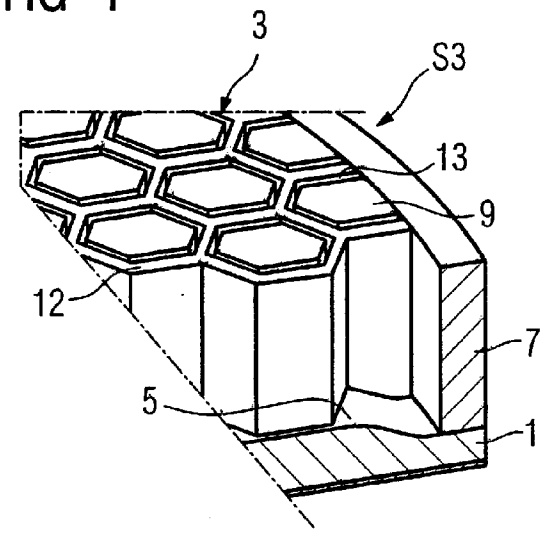
FIG 4

ROTARY ANODE X-RAY RADIATOR

BACKGROUND OF THE INVENTION

1. Field of the Invention

The present invention concerns a rotary anode radiator for generation of x-rays.

2. Description of the Prior Art

DE 1 937 351 A1 and the corresponding U.S. Pat. No. 3,751,702 as well as DE 32 36 386 A1 and the corresponding U.S. Pat. No. 4,531,227 respectively disclose rotary anode radiators with an anode plate made from graphite that exhibits a good heat storage capability and a good heat dissipation. The anode plate is coated with a focal spot path on the side thereof facing the cathode. The focal spot path is produced from a high temperature-resistant material suitable for generation of x-rays, for example from tungsten, molybdenum, tantalum.

Rotary piston radiators or rotary piston tubes generally known from DE 197 41 750 A1 and the corresponding U.S. Pat. No. 6,084,942 as well as from DE 199 56 491 A1 and the corresponding U.S. Pat. No. 6,396,901. A rotatably-supported rotary piston has an anode produced from a suitable material. A cathode is provided situated opposite the anode. An electron beam emanating from the cathode is deflected by means of a magnet device such that it forms an annular focal path on the anode given rotation of the rotary piston. To dissipate the heat, the anode is flushed with a liquid coolant at its external side.

To achieve an optimally fast and effective heat dissipation, the rotary piston is rotated with a relatively high rotation speed of up to 180 revolutions per second. For further increasing the performance of such a rotary piston radiator, in practice it has been attempted to rotate the rotary piston with higher speed, but it has been established that the heat generated in the anode cannot be dissipated to a sufficient degree with a further increase of the rotation speed.

DE 10 2004 003 370 A1 and the corresponding United States Patent Application Publication No. 2005/0185761 A1 as well as DE 10 2004 003 368 A1, which have respectively been published after the priority date of the present patent application, describe rotary piston radiators in which a base of the rotary piston has on its internal side, an anode produced from a first material. A structure for accommodation of at least one heat conductor element produced from a second material is provided on an external side of the base (facing away from the anode) in an annular section situated opposite the anode. The second material exhibits a higher heat conductivity than the first material.

SUMMARY OF THE INVENTION

An object of the present invention is to provide a rotary x-ray anode radiator with improved performance that avoids the disadvantages discussed above.

This object is achieved according to the present invention by a rotary anode x-ray radiator that has an anode produced from a first material, with a structure for accommodation of at least one heat conductor element produced from a second material being provided on an external side of the anode (facing away from the cathode) at least in an annular section thereof situated opposite the cathode. The second material exhibits a higher heat conductivity than the first material, and heat conductor elements are accommodated to form expansion gaps in the structure.

In an embodiment of the rotary anode x-ray radiator, the anode is arranged on the base of a rotary piston on its internal side, or the anode at least partially forms the base of the rotary piston. Such a variant is what is known as a rotary piston x-ray radiator.

Due to the inventive provision of structure for accommodation of expansion, the formation of an out-of-balance conditional due to creep of the second material can be prevented. It is thereby possible to further increase the rotation speed of the rotary anode or of the rotary piston, and so to increase the performance of the rotary anode radiator or of the rotary piston radiator.

The expansion gaps are appropriately dimensioned such that a deformation of the structure due a thermally-caused expansion of the heat conductor elements is avoided. The expansion gaps can extend in the axial and/or radial direction. They can run within heat conductor elements produced from the second material. The heat conductor elements alternatively can enclose the expansion gaps at least in segments.

In a further embodiment, the structure is surrounded by a circumferential external wall provided on the base. The circumferential external wall serves for a mechanical stabilization of the structure and thus increases of the durability of the rotary anode radiator.

The structure can have at least one circumferential partition or dividing wall. The structure can also have a plurality of partitions running radially. The structure can have partitions fashioned like a grid or fashioned like a honeycomb. A structure with such partitions thus forms recesses on the external side of the base, and these recesses enable an accommodation of the second material.

In an another embodiment, the external wall and/or the structure is/are produced from the first material. The external wall and/or the structure is/are at least partially produced in a one-piece design with the base. The structure thus can be produced with a particular design of the external side of the base.

According to a further embodiment of the invention, the first material exhibits a lower stationary creep speed than the second material. For definition of "stationary creep", reference is made to Ilschner: Werkstoffwissenschaften, Springer Verlag 1982, pages 119 through 121. An unwanted deformation of the structure at high temperatures and rotation speeds of the rotary piston is thereby prevented. The formation of an out-of-balance is thereby particularly reliably counteracted.

The first material is appropriately selected or combined from the following group: molybdenum, molybdenum alloys, tungsten, tungsten alloys, steel, heat-resistant copper alloys. The aforementioned materials steel and heat-resistant copper alloy are in particular used in combination with the other cited materials.

The second material is appropriately selected or combined from the following group: copper, copper alloys, copper composites, graphite. The aforementioned second material graphite is typically used in combination with the other cited second materials. Given the use of graphite, a highly heat-conductive pyrolytic graphite is advantageously used that is characterized by a very high density at the atomic level. The second material can be attached to the structure with prevalent attachment methods. It has in particular proven to be appropriate for the second material to be attached in the structure with a solder connection. It is also possible to pour the second material into the recesses formed by the partitions and to introduce expansion gaps after the solidification, for example by means of electrical discharge machining.

In a further embodiment, the structure can have a perforated plate or perforated plate rings, in particular for stabilization of the partitions. The perforated plate or the perforated plate rings can be produced from the following material:

molybdenum, molybdenum alloys, tungsten, tungsten alloys, steel, heat-resistant copper alloys, heat-resistant Ni-base alloys. The external wall can also be produced from a heat-resistant Ni-base alloy.

DESCRIPTION OF THE DRAWINGS

FIG. 1 is a schematic partially cross-sectional view of the base of a rotary anode radiator executed as a rotary piston radiator, in accordance with the invention.

FIG. 2 is a perspective lower view of a first structure shown in FIG. 1.

FIG. 3 is a perspective lower view of a second structure in accordance with the invention.

FIG. 4 is a perspective lower view of a third structure in accordance with the invention.

DESCRIPTION OF THE PREFERRED EMBODIMENTS

Figure 5:
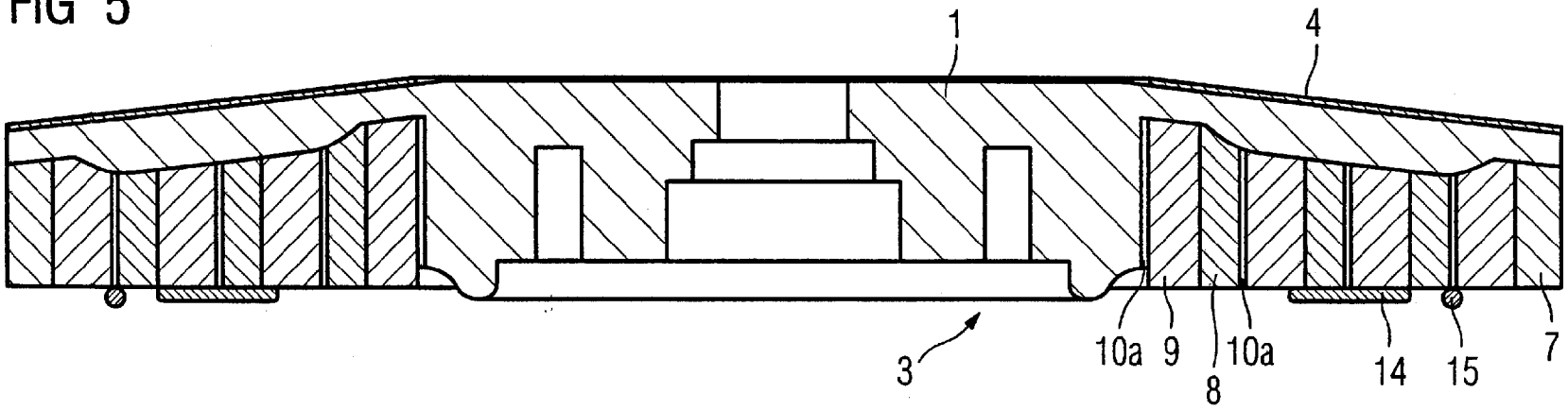
FIG. 5 is a schematic, partially cross-sectional view of the base according to FIG. 1 with seals provided thereon.

FIG. 1 is a schematic, partially cross-sectional view of a base 1 of a rotary piston of an x-ray radiator. An internal side facing toward the inside of the rotary piston is designated with the reference character 2 and an external side flushed by a coolant liquid (not shown here) is designated with the reference character 3. An annular focal path 4 is located on the internal side 2. In the present exemplary embodiment, the internal side 2 of the base 1 forms an anode. An anode produced from a separate material alternatively can be provided on the internal side 2 of the base 1, in particular in the region of the focal path 4. Opposite the focal path 4, the external side 3 exhibits a recess 5 with a convex curved base surface 6. The recess 5 is radially outwardly limited by a circumferential external wall 7.

The base 1 is produced from a first material that exhibits a high temperature resistance, for example, molybdenum, micro-alloyed molybdenum (TZM from the company Plansee AG), tungsten or a tungsten alloy. The first material exhibits a low stationary creep speed, meaning that it deforms only within low limits even at high temperatures.

The external wall 7 can be produced as one piece with the base 1. In this case, the external wall 7 is likewise produced from the first material. The external wall 7 alternatively can be a component connected with the base 1. In this case, the external wall 7 can be produced from a different material, for example steel, a heat-resistant copper alloy, a heat-resistant Ni-base alloy or the like.

Circumferential partitions 8 are attached within the recess 5. The partitions 8 can likewise be produced in one piece formation with the base 1. It is also possible to initially produce the partitions 8 as a separate component and then to connect them with the base 1. Partitions 8 can be produced from the first material or from the second further material for the external wall 7.

The recess 5 forms a first structure S1 together with the partitions 8. Heat conductor elements 9 produced from a second material are attached to the partitions 8. The second material is a material that exhibits a higher heat conductivity than the first material. The second material, for example, can be copper, a copper-base material and the like. In order to ensure an optimally good heat dissipation from the base body of the base 1, the heat conductor elements 9 are attached to the base body with at least one complete surface. To avoid the provision of a separate mechanical attachment, the heat conductor elements 9 can appropriately additionally abut one or more of the partitions 8 or be connected therewith, for example by soldering.

As is apparent from FIGS. 1 and 2, the heat conductor elements 9 are bordered both by circumferential expansion gaps 10*a* and by radial expansion gaps 10*b*. The expansion gaps 10*a*, 10*b* are dimensioned such that stresses caused by thermal expansions of the heat conductor elements 9 are prevented. As is apparent particularly from FIGS. 1 and 2, the recess 5 (possibly in combination with the external wall 7 and the partitions 8) forms a structure S1 which is suitable for accommodation of heat conductor elements.

FIG. 3 shows a second structure S2. The second structure S2 is formed by circumferential partitions 8 provided within the recess 5 and radial partitions 11 radially crisscrossing the circumferential partitions 8. Heat conductor elements 9 are respectively accommodated within the pockets formed by the intersecting partitions 8, 11. The heat conductor elements are in turn bordered by expansion gaps 10*a* that are circumferential in segments and by radial expansion gaps 10*b*. The heat conductor elements are in turn connected with the base 1 as well as one of the partitions 8, 11 with at least two full surfaces.

FIG. 4 shows a third structure S3. Honeycomb-shaped partitions 12 in which the heat conductor elements are accommodated are thereby provided in the recess 5. The heat conductor elements 9 are also in turn separated by further expansion gaps 13 from at least one part of the further partitions 12.

FIG. 5 shows a schematic, partially cross-sectional view of the base 1 shown in FIG. 1. First and second seals 14 and 15 covering the expansion gaps 10*a*, 10*b* are thereby provided on the external side 3. The seals 14, 15 prevent an entrance of coolant fluid into the expansion gaps 10*a*, 10*b*. The seals 14, 15 can be produced from a soft metal that is connected by a solder connection with the heat conductor elements 9 and the partitions 8, 11 or 12. The soft metal can be, for example, copper, aluminum, gold, silver, tantalum, titanium, tin or a soft solder alloy of the aforementioned metals. As is apparent from FIG. 5, the first seal 14 can be formed as a plate and the second seal 15 can be formed as a ring with a circular cross-section. The seals 14, 15 can, however, be formed differently. Only first seals 14 or only second seals 15 can be used.

Figure 6:
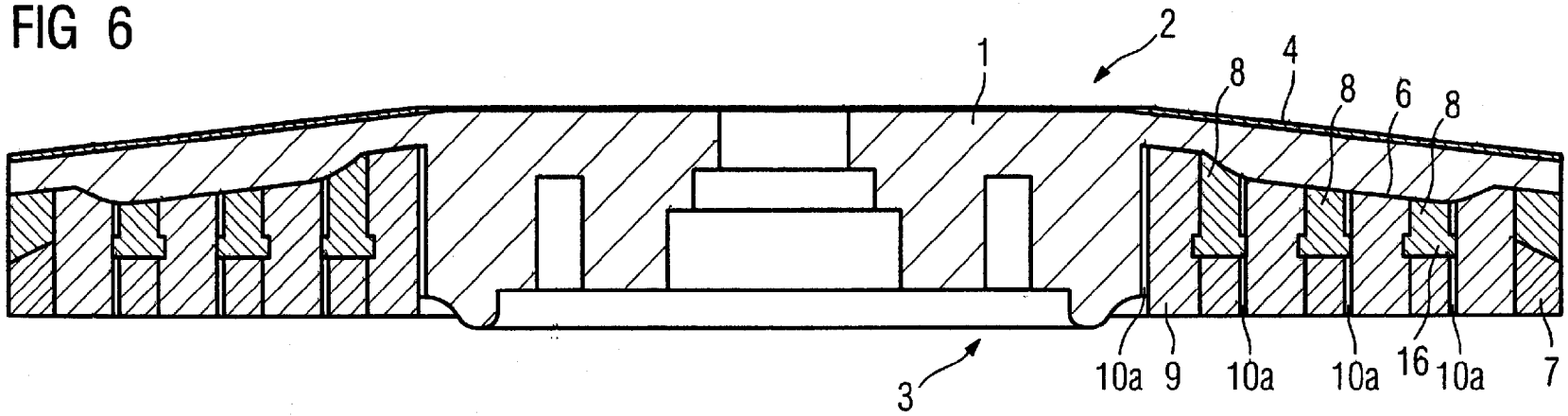
FIG. 6 is a schematic, partially cross-sectional view of a further embodiment of the base.

FIG. 6 shows a schematic, partially cross-sectional view of a further base 1. Radially circumferential first partitions 8 are provided in the recess 5 on the convex curved base segment 6 provided there. The radially circumferential partitions 8 can be initially produced from the first material towards the external side 3 and furthermore from a third material that exhibits a higher heat conductivity than the first material. A perforated plate 16 can be provided between the partitions 8 produced from the first material and the partitions 8 produced from the third material. Perforated plate rings can also be used instead of the perforated plate 16.

In a segment adjacent to the base surface 6, the heat conductor elements 9 can comprise a further material, for example graphite, graphite with C-mesofibers or C-nanofibers or C-nanotubes or Sondergraphit, with very high heat conductivity. In a segment facing towards the external side 3, the heat conductor elements 9 can be produced from the second material.

The structures S1, S2, S3 function as follows.

Heat occurring on the focal path 4 due to the deceleration of incident electrons is transferred to the thermally-coupled heat conductor elements 9. A deformation of the base 1 caused by thermal expansions is prevented by a larger thickness of the base body (advantageously with convex curvature) in the region of the base surface 6. In comparison with the partitions 8, 11, 12 as well as the external wall 7, the heat conductor elements 9 exhibit a lower dimensional stability (deformation resistance), meaning that their static creep speed is higher. Creep of the second materials possibly caused by the high revolution speed of the base 1 is suppressed by the partitions 8, 11, 12 and the external wall 7 given the proposed structures S1, S2, S3. Given the structure S3, an additional mechanical stabilization of the partition 8 ensues via a perforated plate 16. In this case, the partitions 8 an be made thinner and the radiation of heat can thereby be improved. The formation of thermal stresses caused by a thermal expansion of the heat conductor elements 9 is prevented by the provision of the expansion gaps 10*a*, 10*b* and 13.

Figure 7:
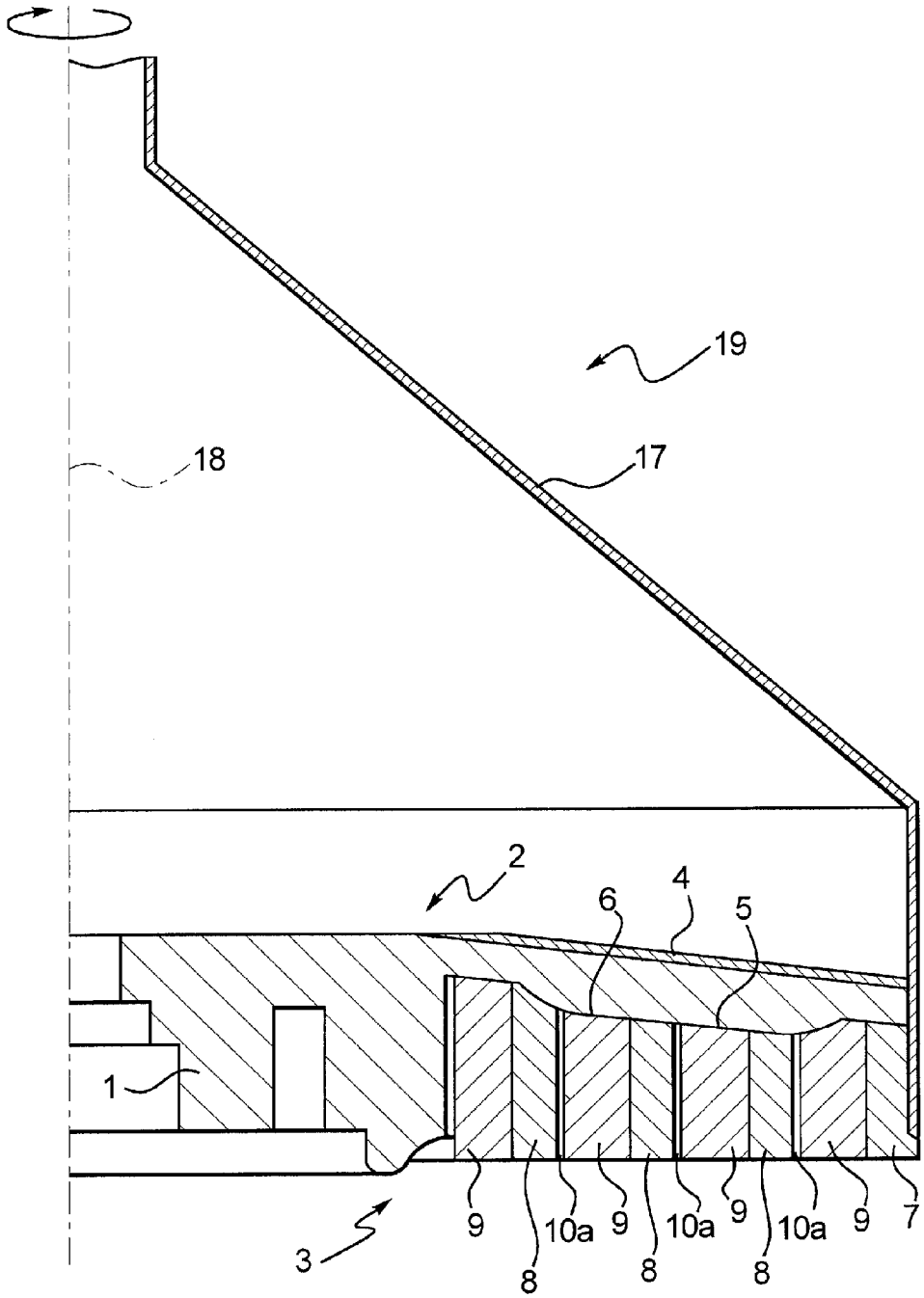
FIG. 7 is a schematic, partially cross-sectional view of a rotary piston embodying the base shown in FIG. 1.

As shown in FIG. 7, the base 1 can form the base of a rotary piston 19 is rotatable around an axis 18. Due to the structures S1, S2, S3 in combination with the heat conductor elements 9, an extremely fast and efficient heat dissipation from the focal path 4 can be ensured even at high rotation speeds. Such a rotary anode x-ray radiator with the base 1, incorporating the structures S1, S2, S3 in combination with the heat conductor elements 9, forming the base of the rotary piston 19 can be operated with higher efficiencies.

Although modifications and changes may be suggested by those skilled in the art, it is the intention of the inventor to embody within the patent warranted hereon all changes and modifications as reasonably and properly come within the scope of his contribution to the art.

The invention claimed is:

1. A rotary anode radiator comprising:

a cathode that emits an electron beam;

an anode at which said electron beam is incident at a focus, said anode being mounted for rotation around an axis so that said focus exhibits a focus path on a first surface of said anode facing said cathode;

said anode having an anode body comprised of a first material and having a second side, facing away from said cathode, opposite said first side;

a structure disposed in an annular recess of said anode body at said second side of said anode and being co-rotatable with said anode, with a portion of said anode body between said structure and said first surface, at least a portion of said structure being beneath said focus path, and at least two heat conductor elements held in said structure in said annular recess at said second side of said anode body, said at least two heat conductor elements being comprised of a second material having a higher heat conductivity than said first material; and said at least two heat conductor elements being held in said structure in said annular recess with an expansion gap between said at least two heat conductor elements in said structure in said annular recess.

2. A rotary anode radiator as claimed in claim 1 comprising a rotary piston having a base, said anode being disposed on an interior side of said base.

3. A rotary anode radiator as claimed in claim 1 comprising a rotary piston, with said anode forming at least a portion of a base of said rotary piston.

4. A rotary anode radiator as claimed in claim 1 wherein said at least two heat conductor elements are held in said structure in said annular recess to form an expansion gap therebetween having a size that allows thermal expansion of said at least two heat conductor elements during emission of said electron beam without deforming said structure.

5. A rotary anode radiator as claimed in claim 1 wherein said expansion gap proceeds parallel to said axis.

6. A rotary anode radiator as claimed in claim 1 wherein said expansion gap proceeds radially with respect to said axis.

7. A rotary anode radiator as claimed in claim 1 comprising a circumferential external wall surrounding said structure.

8. A rotary anode radiator as claimed in claim 1 wherein said structure comprises at least one circumferential partition.

9. A rotary anode radiator as claimed in claim 1 wherein said structure comprises a plurality of partitions proceeding radially relative to said anode.

10. A rotary anode radiator as claimed in claim 1 wherein said structure comprises partitions forming a grid.

11. A rotary anode radiator as claimed in claim 1 wherein said structure comprises partitions forming a honeycomb.

12. A rotary anode radiator as claimed in claim 1 wherein said structure is comprised of said first material.

13. A rotary anode radiator as claimed in claim 1 wherein said anode body and said structure comprise a unitary component.

14. A rotary anode radiator as claimed in claim 1 wherein said first material has a lower stationary creep speed than said second material.

15. A rotary anode radiator as claimed in claim 1 wherein said first material is at least one material selected from the group consisting of molybdenum, molybdenum alloys, tungsten, tungsten alloys, steel, heat-resistant copper alloys, and heat-resistant nickel-based alloys.

16. A rotary anode radiator as claimed in claim 1 wherein said second material is at least one material selected from the group consisting of copper, copper alloys, copper composites, and graphite.

17. A rotary anode radiator as claimed in claim 1 comprising a solder connection connecting said at least two heat conductor elements to said structure.

18. A rotary anode radiator as claimed in claim 1 wherein said structure comprises a perforated component selected from the group consisting of a perforated plate and perforated plate rings.

19. A rotary anode radiator as claimed in claim 18 wherein said perforated component is at least one material selected from the group consisting of molybdenum, molybdenum alloys, tungsten, tungsten alloys, steel, heat-resistant copper alloys, and heat-resistant nickel-based alloys.

20. A rotary anode radiator as claimed in claim 1 comprising an external wall circumferentially surrounding said anode body, comprised of a heat-resistant nickel-based alloy.

* * * * *